US008366083B1

(12) United States Patent
Herrmann et al.

(10) Patent No.: US 8,366,083 B1
(45) Date of Patent: Feb. 5, 2013

(54) TENSIONING DEVICE FOR TENSIONING A STRAP OF A METAL WALL STRUCTURE

(75) Inventors: James E. Herrmann, Raleigh, NC (US); Michael A. Shultz, Apex, NC (US); John C. Herrmann, Raleigh, NC (US)

(73) Assignee: The Steel Netork, Inc., Durham, NC (US)

( * ) Notice: Subject to any disclaimer, the term of this patent is extended or adjusted under 35 U.S.C. 154(b) by 648 days.

(21) Appl. No.: 12/582,186

(22) Filed: Oct. 20, 2009

(51) Int. Cl.
*B25B 1/00* (2006.01)
*E04C 3/02* (2006.01)

(52) U.S. Cl. ..... 269/6; 52/693

(58) Field of Classification Search ..... 269/6, 259, 269/271; 52/573.1, 291
See application file for complete search history.

(56) References Cited

U.S. PATENT DOCUMENTS 1,262,301 A * 4/1918 Blest ..... 105/411
2,995,797 A * 8/1961 Hoffmann ..... 52/291
4,022,537 A * 5/1977 Gilb et al. ..... 403/386
4,235,054 A * 11/1980 Cable et al. ..... 52/210
6,155,019 A * 12/2000 Ashton et al. ..... 52/849
6,161,339 A * 12/2000 Cornett et al. ..... 52/23
6,192,637 B1 * 2/2001 Boilen et al. ..... 52/167.3
6,493,998 B1 * 12/2002 Pryor ..... 52/92.2
7,516,577 B1 * 4/2009 Ranieri et al. ..... 52/90.1
7,685,788 B1 * 3/2010 Torres et al. ..... 52/573.1
7,743,479 B1 * 6/2010 Torres et al. ..... 29/446
7,748,180 B1 * 7/2010 Plavidal ..... 52/223.8
7,757,439 B1 * 7/2010 Ranieri et al. ..... 52/63
8,091,874 B2 * 1/2012 Ray Avalani ..... 269/6
2001/0037611 A1 * 11/2001 Cornett, Sr. ..... 52/23
2005/0248074 A1 * 11/2005 Ray Avalani ..... 269/6
2005/0280196 A1 * 12/2005 Ray Avalani ..... 269/6
2007/0022701 A1 * 2/2007 Surowiecki ..... 52/693
2007/0176342 A1 * 8/2007 Noniewicz ..... 269/6

* cited by examiner

*Primary Examiner* — Lee D Wilson
*Assistant Examiner* — Jamal Daniel
(74) *Attorney, Agent, or Firm* — Coats & Bennett, P.L.L.C.

(57) ABSTRACT

A tensioning device is provided for tensioning the metal strap of a metal wall structure. The tensioning device includes an elongated bar having a handle and a pair of jaws where one jaw is secured to the elongated bar and another jaw projects from the handle. The jaws are operatively connected between the metal strap and the wall structure. In particular, one jaw is operatively connected or anchored to the wall structure and the other jaw is connected to the metal strap. The handle includes a trigger mechanism for moving the jaws with respect to each other. By actuating the trigger mechanism and closing the jaws, the metal strap is tensioned. After the metal strap is tensioned, it is securely fastened to the wall structure.

12 Claims, 7 Drawing Sheets

TENSIONING DEVICE FOR TENSIONING A STRAP OF A METAL WALL STRUCTURE

FIELD OF THE INVENTION

The present invention relates to metal wall structures and metal wall structures having tensioning straps, and more particularly to a device for tensioning the metal straps of a wall structure.

BACKGROUND OF THE INVENTION

Metal wall sections are commercially fabricated and delivered to construction sites for erection. Typically metal wall sections include upper and lower channel sections and a series of spaced apart metal studs extending between the upper and lower channel sections. In some cases, columns are provided about opposite end sections of the wall. Further, in some cases, the corner areas of the metal wall section are reinforced.

In many cases, it is advantageous to provide additional structure rigidity by incorporating one or more bridging members or by utilizing diagonal strapping. Diagonal straps provide rigidity to the wall section as a whole. When used in prefabricated modular wall sections these diagonal straps extend from opposed corners and cross about a center area of the wall section. Diagonal straps have applications in places other than in prefabricated wall sections. Diagonal straps are also used in conventional built-in-place modular walls.

One of the difficulties in providing prefabricated metal wall sections or conventional built-in-place metal walls with strapping is that it is difficult to effectively and efficiently tension the respective straps. First it is difficult to tension the straps manually using conventional tools. Even in cases where a great deal of care and patience is exercised, the straps are not typically fully tensioned, and accordingly, the metal wall, as a whole, lacks the desired rigidity.

Therefore, there has been and continues to be a need for an apparatus and method for efficiently and effectively tensioning and securing wall straps to sections of a metal wall.

SUMMARY OF THE INVENTION

The present invention relates to a tensioning device for tensioning a metal strap associated with the metal wall structure. The tensioning device includes a clamping apparatus having an elongated bar that includes opposed attaching structures that attach to the metal wall and to the strap to be tensioned. The tensioning device includes an actuator that causes the two attaching structures to be drawn together or closed and this results in the strapped being tensioned.

In one particular embodiment, the tensioning device includes an apparatus similar to a bar clamp where the bar clamp includes two opposed jaws or attaching structures. The jaws or attaching structures are connected to both the metal strap to be tensioned and the metal wall structure. The tensioning device is actuated causing the jaws or attaching structures to be closed, and in the process the metal strap is tensioned. After the metal strap has been tensioned, it is secured in place on the metal wall structure.

Other objects and advantages of the present invention will become apparent and obvious from a study of the following description and the accompanying drawings which are merely illustrative of such invention.

DESCRIPTION OF THE PREFERRED EMBODIMENT

Figure 1:
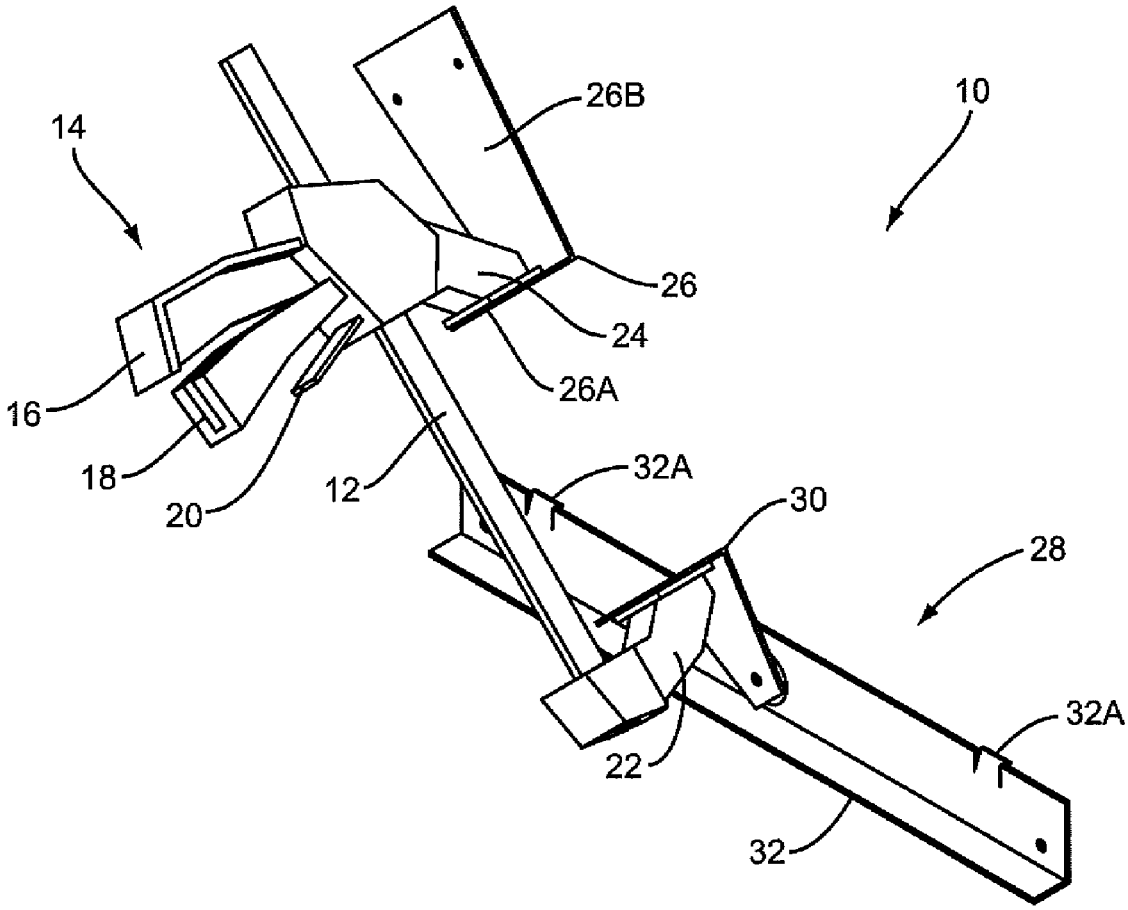
FIG. 1 is a perspective view of the strap tensioning device of the present invention.
Figure 2:
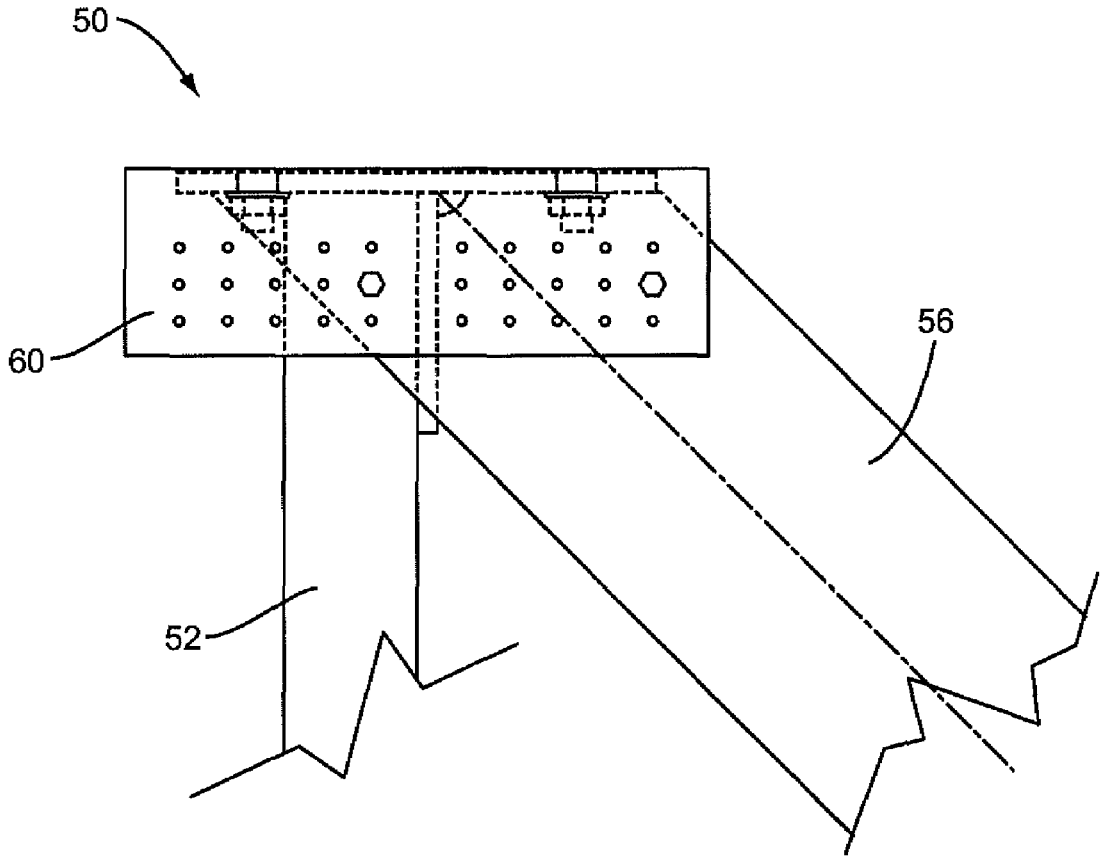
FIG. 2 is a fragmentary sectional view of an upper portion of a wall section, particularly illustrating a portion of a metal strap.

With further reference to the drawings, the strap tensioning device 10 is shown therein. Strap tensioning device 10 is designed to tension the straps of a wall structure. A typical wall structure is shown in FIG. 7. In this case, the wall structure is indicated generally by the numeral 50 and includes two wall sections, one disposed over the other. Each wall section includes a pair of spaced apart columns 52. The columns 52 are generally more robust and stronger than a single stud. However, the wall structure 50 does include studs 54 that are spaced apart and are disposed generally between a pair of columns 52. Each wall section shown in FIG. 7 includes a pair of diagonal metal straps 56. It is these metal straps 56 that the tensioning device 10 engages and tensions. Typically, wall structure 50 includes upper and lower tracks 58. These are generally U-shaped metal tracks that receive opposed ends of the studs 54 and columns 52. Disposed about the four corners of a wall section is a strap track 60. This is particularly shown in FIGS. 3-6. Strap track 60 is seated in a track 58 and is of a U-shaped construction. That is, each strap track 60 includes a web and a pair of flanges with the flanges including opening for receiving fasteners. One or more anchor bolts 62, as shown in FIGS. 3-6, is utilized to secure various components of the wall structure about the opposed corners of each wall section.

For a more complete and unified understanding of wall structures wall sections, and strap tensioning devices one is referred to the disclosure found in U.S. patent application Ser. No. 10/988,032 filed Nov. 12, 2004 and entitled "A Wall Strap Tensioner for Tensioning a Wall Strap of a Metal Wall." The disclosure and drawings of this application are expressly incorporated herein by reference.

With reference to FIG. 1, the strap tensioning device 10 is shown therein. The strap tensioning device 10 includes an elongated bar or rod 12. A handle and actuator assembly indicated generally by the numeral 14 is supported on the bar. Handle and actuator assembly 14 includes a handle 16 and an actuator or trigger 18. A release tab 20 depends downwardly in front of the trigger 18. The structure of the elongated bar 12 and handle and actuator assembly 14 is commonly found in structures such as bar clamps. Here, actuating the trigger 18 causes the elongated bar 12 to move with respect to the handle and actuator assembly 14. The movement of the elongated bar 12 can be reversed by simply engaging the release 20. Details of the internal mechanisms utilized to achieve this action is not dealt with herein because such is not per se material to the present invention, and further, these mechanisms and structures are well known in the prior art.

A first jaw 22 is secured to one end of the elongated bar 12. The term "jaw" as used herein means a structure that can be connected to, such as, for example, a block on a plate, bracket, etc. A second jaw 24 is associated with the handle and actuator assembly 14. Note in FIG. 1 where the second jaw 24 projects from the handle and actuator assembly 14 and is generally aligned with the first jaw 22.

The strap tensioning device 10 is designed to be connected between a wall strap 56 and an anchoring structure, such as a portion of the wall structure 50. In the example illustrated herein, the strap tensioning device 10 is interconnected between a strap 56 and a track 58 that forms a part of the wall structure 50. Therefore, the strap tensioning device 10 is provided with a strap connector 26. Strap connector 26 is connected to the second jaw 24. Strap connector 26 in this embodiment includes a generally angled or L-shaped bracket that comprises a first plate 26A that is attached to jaw 24 and a second plate 26B. Second plate 26B is configured to connect to strap 56. As seen in FIGS. 3-6, the strap connector 26 is designed to fit or connect flush against the side of a strap 56.

In addition, the strap tensioning device 10 includes an anchoring connector or wall connector indicated generally by the numeral 28. The wall connector 28 is designed to anchor or hold the strap tensioning device 10 while the device is tensioning a metal strap 56. In the case of the embodiment illustrated herein, the wall connector 28 is designed to connect to a portion of the wall structure 50.

Viewing the wall connector 28 in more detail, the same includes a bracket 30 that is connected to the first jaw 22. Bracket 30 is in turn pivotally connected to a track connector 32. Note that track connector 32 is elongated and is basically an L-shaped piece of metal that includes a base and an upstanding flange. The upstanding flange includes one or more fastener openings for receiving fasteners such as screws and the like which are secured into a portion of a track 58. Note that the upstanding flange of the track connector 32 includes two spaced apart stops 32A that project from one side of the track connector. The stops 32A are particularly spaced apart so as to receive a portion of the wall structure 50. When a portion of the wall structure is confined within the stops 32A, it follows that the wall connector 28 or the track connector 32 cannot move laterally back and forth. In the case of one embodiment, the length of the strap track 60 and the space between the stops 32A are designed such that the strap track 60 fits between the stops and that the stops abut opposed end portions of the strap track. This prevents the track connector 32 from moving laterally back and forth during the tensioning process.

FIGS. 2-6 illustrate how the tensioning device 10 is used to tension strap 56 of the wall structure 50. First, in FIG. 2 it is shown how the strap 56 is connected to the upper left portion of a wall section. Note column 52 extending downwardly from an upper disposed strap track 60. The strap 56 is aligned with the center between the anchor bolts shown. The strap 56 is installed between the strap track 60 and the adjacent column 52.

Figure 3:
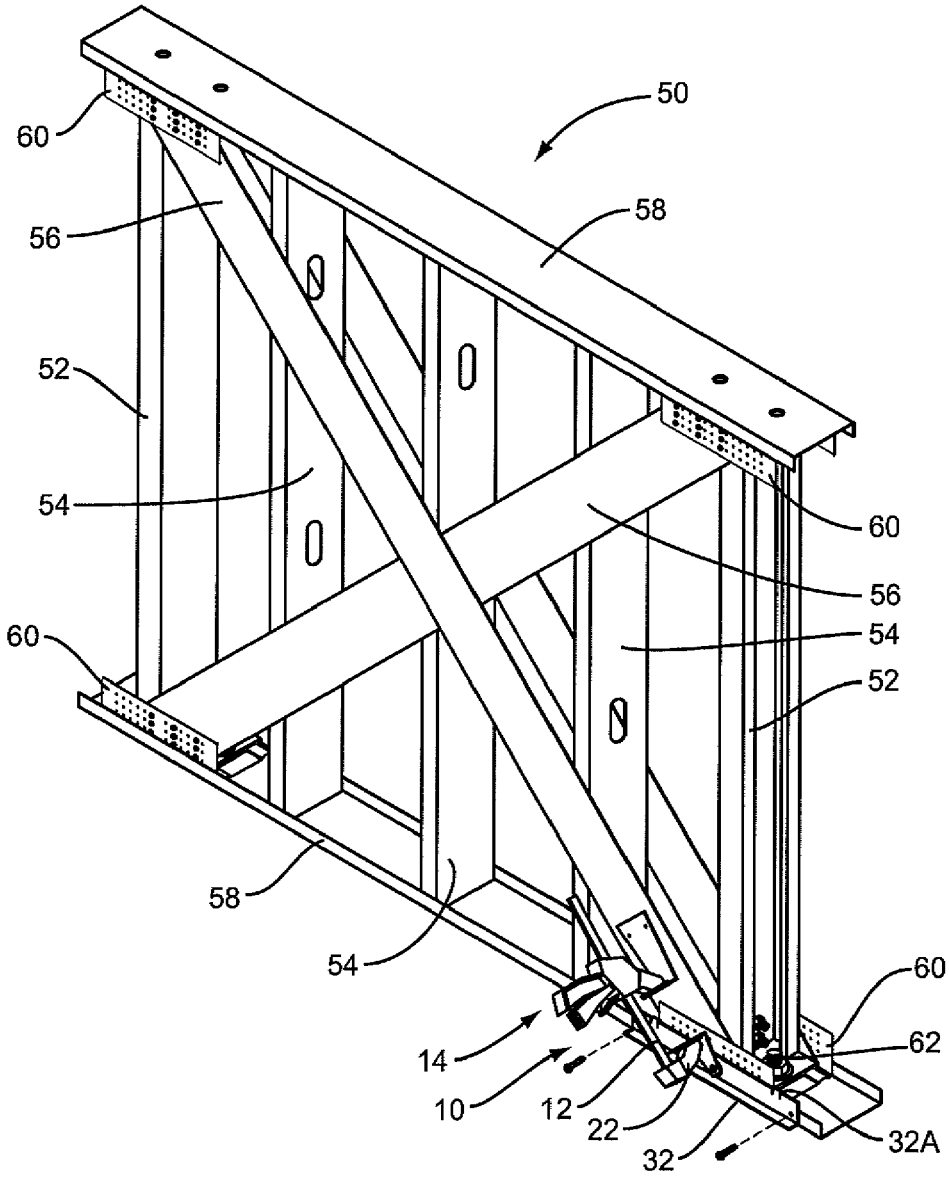
FIG. 3 is a perspective view showing the strap tensioning device being secured to the lower right hand portion of a wall section.

Turning to FIG. 3, the tensioning device 10 is shown being secured to a portion of the wall structure 50. Here, the track connector 32 is properly aligned with the adjacent strap track 60. That is, the strap track 60 is projected between the stops 32A which again generally prevents the track connector 32 from moving laterally back and forth.

The track connector is temporarily attached by screws to the adjacent lower track 58. This anchors the tensioning device 10 to the lower right hand portion of the wall section.

Figure 4:
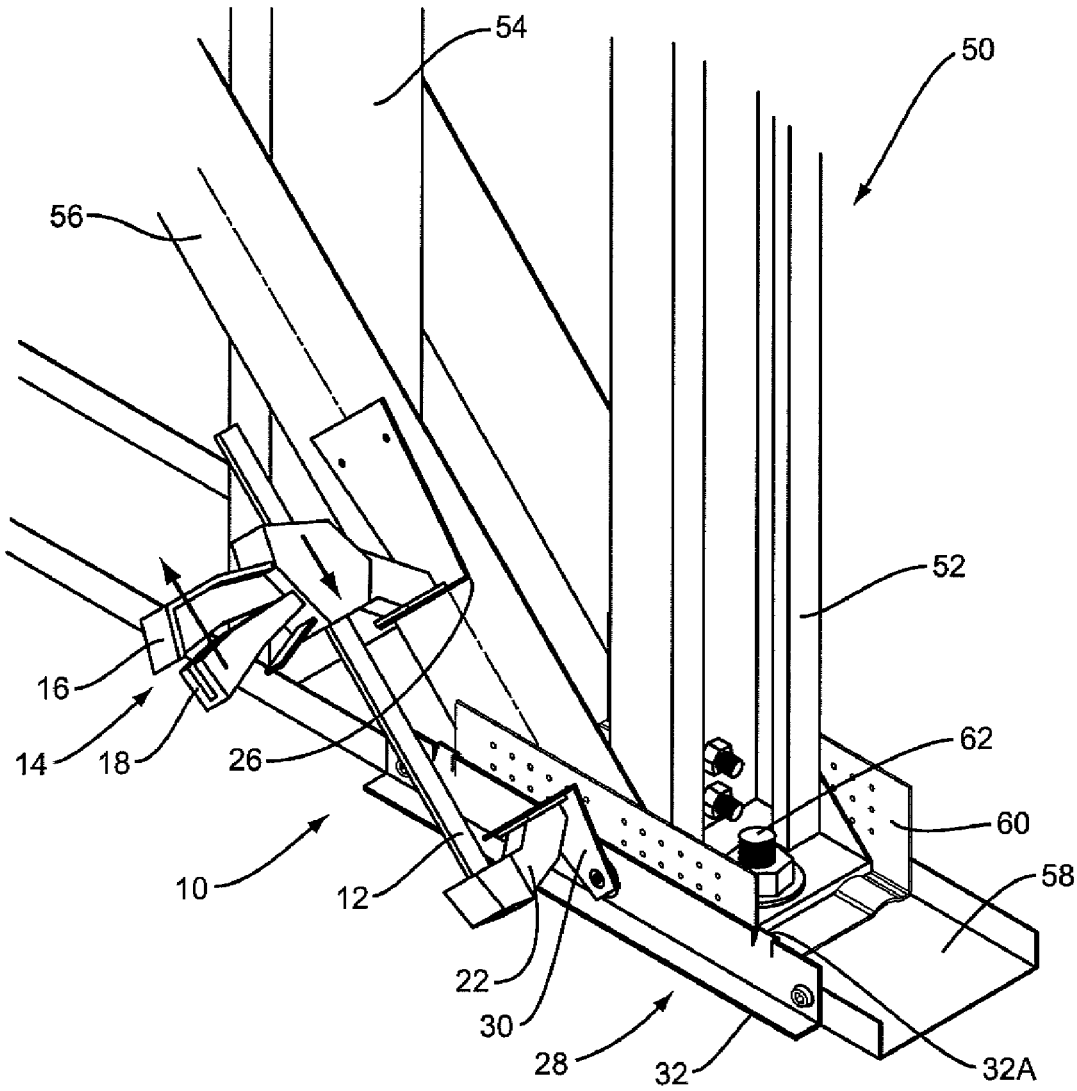
FIG. 4 is a perspective view similar to FIG. 3 and particularly illustrating the tensioning device being connected to the strap of the wall structure.

In FIG. 4, the strap connector 26 is aligned with the center line of the strap 56. The strap connector 26 is fastened or secured to the strap 56. During this time, the lower terminal end portion of the strap is properly aligned such that the lower end portion of the strap is projected between the strap track 60 and the adjacent column 52.

Figure 5:
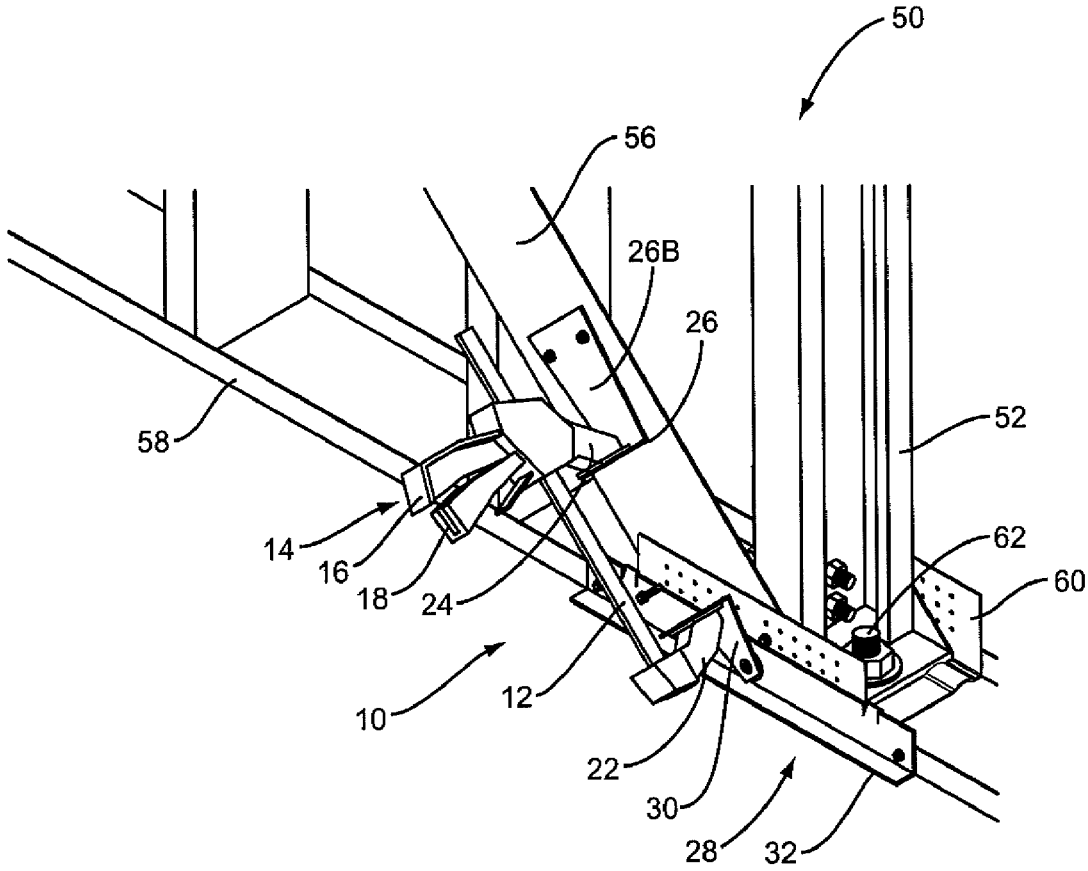
FIG. 5 is a view similar to FIGS. 3 and 4 which illustrate the tensioning device tensioning the strap.

FIG. 5 illustrates the strap 56 being tensioned by the tensioning device 10. The trigger 18 is repeatedly squeezed, causing the first and second jaws 22 and 24 to be moved closer to each other. This causes the strap 56 to be tightened or tensioned. Once the appropriate tension in the strap 56 is realized, two or more screws are inserted through the openings in the flanges of the strap track 60 and into the lower end of the strap 56 so as to generally fix the strap between diagonally opposed strap tracks 60.

Figure 6:
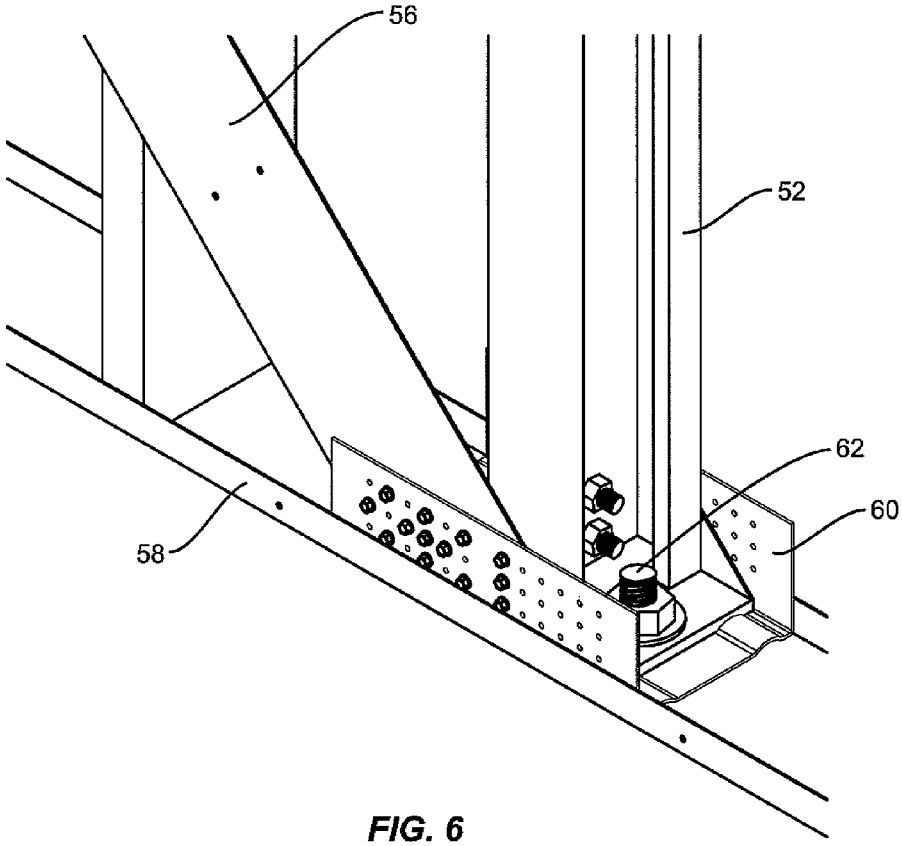
FIG. 6 is a view similar to FIGS. 3-5, but showing the strap after being tensioned connected to the wall structure.
Figure 7:
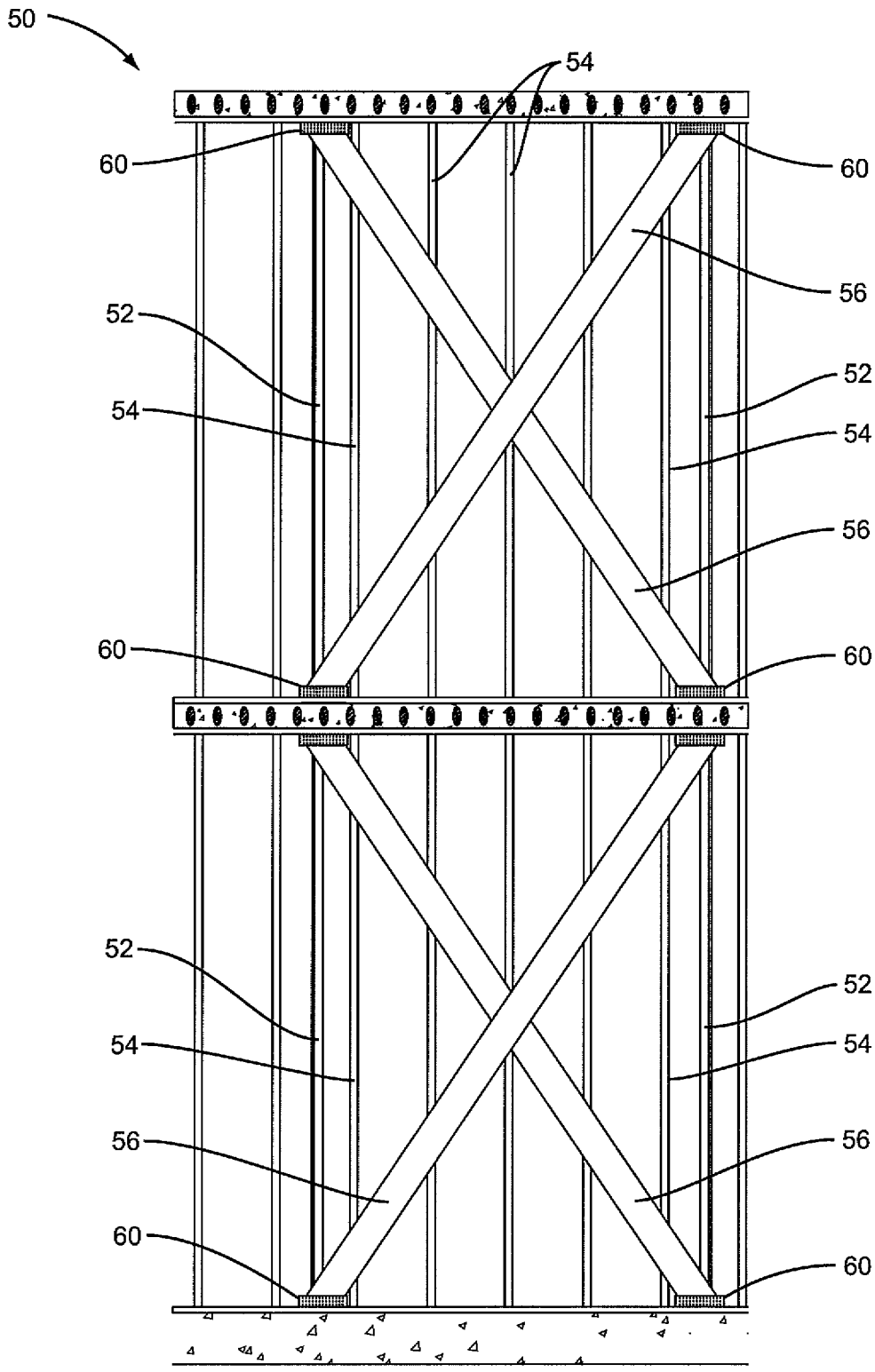
FIG. 7 is a side elevational view of a wall structure including two wall sections with each wall section including two diagonal straps.

FIG. 6 shows the tensioning device removed from the wall structure. Once removed from the wall structure 50, additional screws can be inserted through the flange of the strap track 60 to securely fasten the strap 56 to the strap track. This process is repeated for each of the straps 56 of the wall structure 50.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A strap tensioning device for tensioning a metal strap of a metal wall structure, the wall strap tensioning device comprising:

a. an elongated bar;

b. a handle supported on the elongated bar and wherein the elongated bar is movable back and forth with respect to the handle;

c. first and second jaws, the first jaw mounted to the elongated bar and movable back and forth with the elongated bar and wherein the second jaw is connected to the handle;

d. a trigger for actuating the tensioning device and causing the elongated bar and the first jaw to move with respect to the second jaw;

e. a strap connector for connecting the metal strap to the second jaw;

f. a wall connector for connecting to the metal wall structure, the wall connector being operatively connected to the first jaw such that the wall connector can pivot with respect to the first jaw so as to be aligned with a select portion of the metal wall structure;

g. wherein when the wall connector is connected to the metal wall structure and the strap connector is connected to the metal strap, the metal strap can be tensioned by actuating the tensioning device and causing the first jaw and the elongated bar to move with respect to the second jaw which results in the metal wall strap being tensioned and wherein after the metal strap is tensioned, the metal wall strap can be fastened to the metal wall structure; and h. wherein the wall connector includes a bracket connected to the first jaw and pivotally connected to a track connector for connecting to a track that forms a part of the metal wall structure, and wherein the track connector includes an elongated angle bracket having a base and an upstanding flange and wherein the flange is configured to rest adjacent the track of the metal wall structure and configured to be connected thereto such that when the metal strap is being tensioned, the track connector is anchored to the track of the metal wall structure.

2. The strap tensioning device of claim 1 wherein the track connector includes two spaced apart stops and wherein the stops are spaced apart a selected distance to enable a selected portion of the metal wall structure to fit between the stops such that the two spaced apart stops prevent the track connector from laterally shifting when the metal strap is being tensioned.

3. The strap tensioning device of claim 2 wherein the strap connector includes an L-shaped bracket having a first plate connected to one of the jaws and a second plate extending therefrom and configured to lie flush against the metal strap to be tensioned.

4. The strap tensioning device of claim 1 wherein the wall connector is connected to the first jaw that is secured to the elongated bar and movable therewith, and wherein the strap connector is secured to the second jaw, and wherein the second jaw is integral with the handle.

5. A strap tensioning device for tensioning a metal strap of a metal wall structure, the strap tensioning device, comprising:

i. an elongated bar;

j. a handle mounted on the elongated bar and including a trigger which upon actuation causes the elongated bar to move with respect to the handle;

k. a first jaw mounted on the elongated bar and movable therewith;

l. a second jaw integral with the handle;

m. a strap connector bracket for connecting to the metal strap, the strap connecting bracket being connected to the second jaw;

n. an anchoring connector for anchoring the tensioning device, the anchoring connector comprising:

i) a bracket connected to the first jaw and movable back and forth with the first jaw as the elongated bar is moved with respect to the handle;

ii) a connector pivotally connected to the bracket that is connected to the first jaw;

iii) the connector being configured to connect to an anchoring structure for anchoring the tensioning device; and iv) the connector including an elongated L-shaped bracket having a base and an upstanding flange;

o. wherein by attaching the strap connector bracket to the metal strap and connecting the anchoring connector to the anchoring structure and actuating the tensioning device, the first and second jaws are moved closer together and act to tension the metal strap.

6. The strap tensioning device of claim 5 wherein the L-shaped bracket includes a pair of spaced apart stops and wherein the spaced apart stops are selectively spaced apart such that a portion of the metal wall structure can be inserted between the stops to prevent the track connector from moving back and forth laterally.

7. The strap tensioning device of claim 5 wherein the strap connector bracket includes first and second plates that form an angle and wherein the first plate is secured to the second jaw and the second plate is configured to lie flush against the metal wall strap and to be connected thereto.

8. The strap tensioning device of claim 7 wherein the bracket that forms a part of the anchoring connector includes first and second plates with one plate being connected to the first jaw and the second plate being pivotally connected to the connector that forms a part of the anchoring connector.

9. The strap tensioning device of claim 5 wherein the elongated bar, handle, first and second jaws and strap connector form an integral structure that is pivotal with respect to the connector that forms a part of the anchoring connector.

10. A method of tensioning the metal strap of a wall structure, comprising:

p. connecting a bar clamp between the strap and a portion of the wall structure including operatively connecting a first jaw of the bar clamp to a portion of the wall structure and operatively connecting a second jaw of the bar clamp to the metal strap;

q. actuating the bar clamp and causing the first and second jaws to close and thereby stretch and tension the metal strap; and r. after stretching and tensioning the metal strap, fastening the metal strap to the wall structure.

11. The method of claim 10 wherein the first jaw is operatively connected to the wall structure through a bracket pivotally connected to a track connector, and wherein the method includes anchoring the bar clamp by securing the track connector to a track that forms a part of the wall structure such that the bar clamp can pivot with respect to the track connector and wherein the track connector effectively anchors the bar clamp.

12. The method of claim 11 wherein the bar clamp includes an elongated bar having the first jaw connected thereto, and wherein the bar clamp includes a handle supported on the elongated bar and wherein the handle includes the second jaw; and wherein the method includes repeatedly squeezing a trigger associated with a handle causing the elongated bar to move with respect to the handle and causing the jaws to close which effectively tensions the metal strap.

* * * * *